US006966678B2

(12) United States Patent
Hsieh

(10) Patent No.: US 6,966,678 B2
(45) Date of Patent: Nov. 22, 2005

(54) FOLDABLE CEILING LAMP

(76) Inventor: Bi Hua Hsieh, 235 Chung-Ho Box 8-24, Taipei (TW)

( * ) Notice: Subject to any disclaimer, the term of this patent is extended or adjusted under 35 U.S.C. 154(b) by 155 days.

(21) Appl. No.: 10/647,570

(22) Filed: Aug. 26, 2003

(65) Prior Publication Data

US 2005/0047150 A1 Mar. 3, 2005

(51) Int. Cl.[7] ..... F21S 8/06

(52) U.S. Cl. ..... 362/406; 362/404; 362/405; 362/147

(58) Field of Search ..... 362/404, 405, 362/406, 407, 408, 433, 441, 442, 450, 453, 362/454, 147, 148, 150, 576

(56) References Cited

U.S. PATENT DOCUMENTS 6,600,102 B1 * 7/2003 Wu ..... 174/50
6,793,525 B2 * 9/2004 Wu ..... 362/438
6,840,651 B2 * 1/2005 Wu ..... 362/226

FOREIGN PATENT DOCUMENTS

GB 23842 97 A * 7/2003

* cited by examiner

*Primary Examiner*—John Anthony Ward
*Assistant Examiner*—Bao Q. Truong

(57) ABSTRACT

A foldable ceiling lamp includes a wire connection box and a limiting disk, and a lamp rod. The wire connection box includes an upper cover and a wire connection box body. A gap is formed between the upper cover and the body for being inserted by a supporting plate of the lamp rod. The limiting disk has a plurality of positioning pivotal holes formed on the limiting disk near an edge of the limiting. Each of the positioning pivotal hole is around by a plurality of embedding holes. A bottom of the lamp rod is installed with a plurality of stepped supporting plates. The supporting plates are installed on the positioning pivotal holes of the limiting disk by a pivotal stud. When the supporting plate rotates around the stud, the convex portion of the supporting plate is embedded into one embedding hole. Thus, the lamp rod is rotatable.

4 Claims, 7 Drawing Sheets

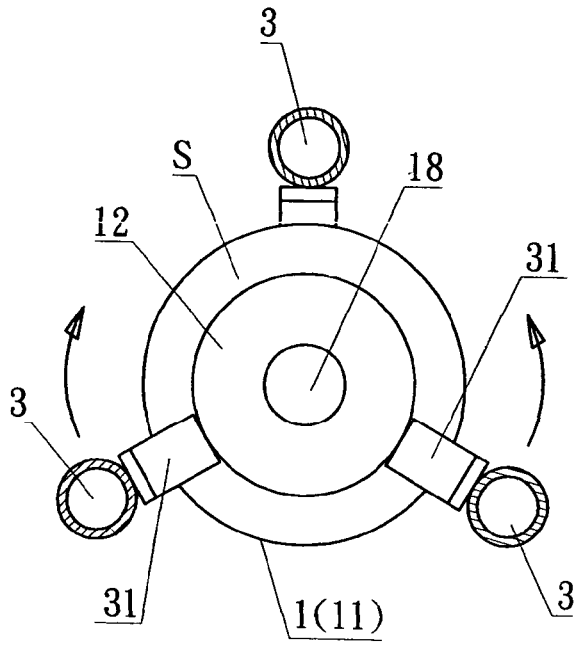
FIG3-A
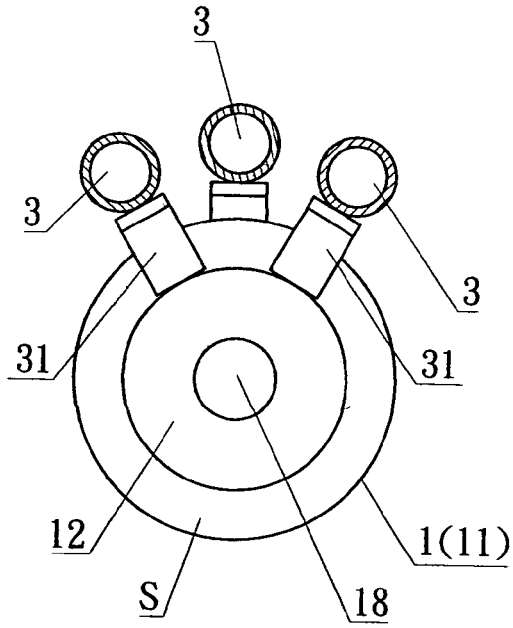
FIG3-B

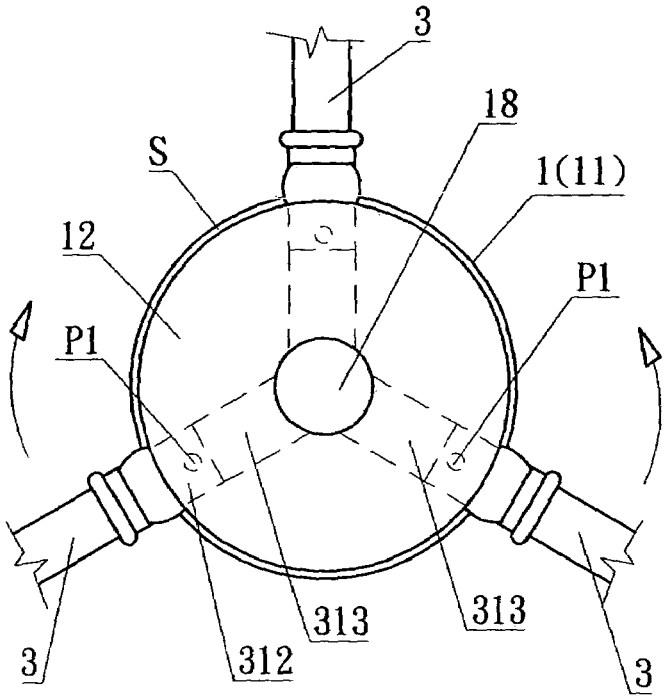
FIG6-A
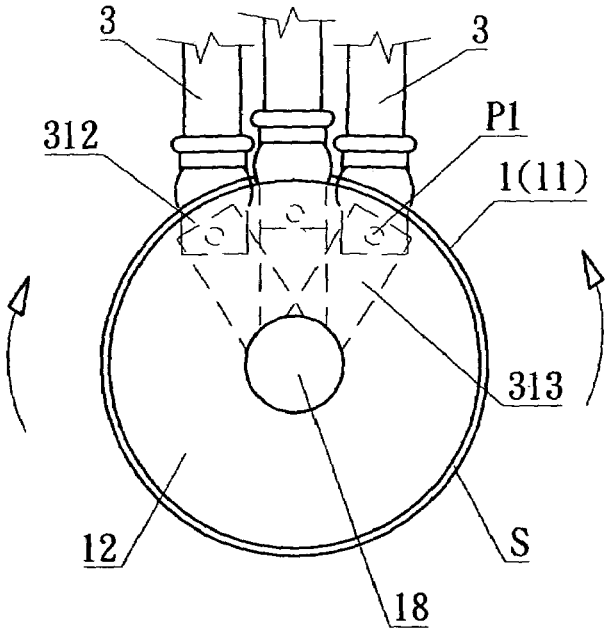
FIG6-B

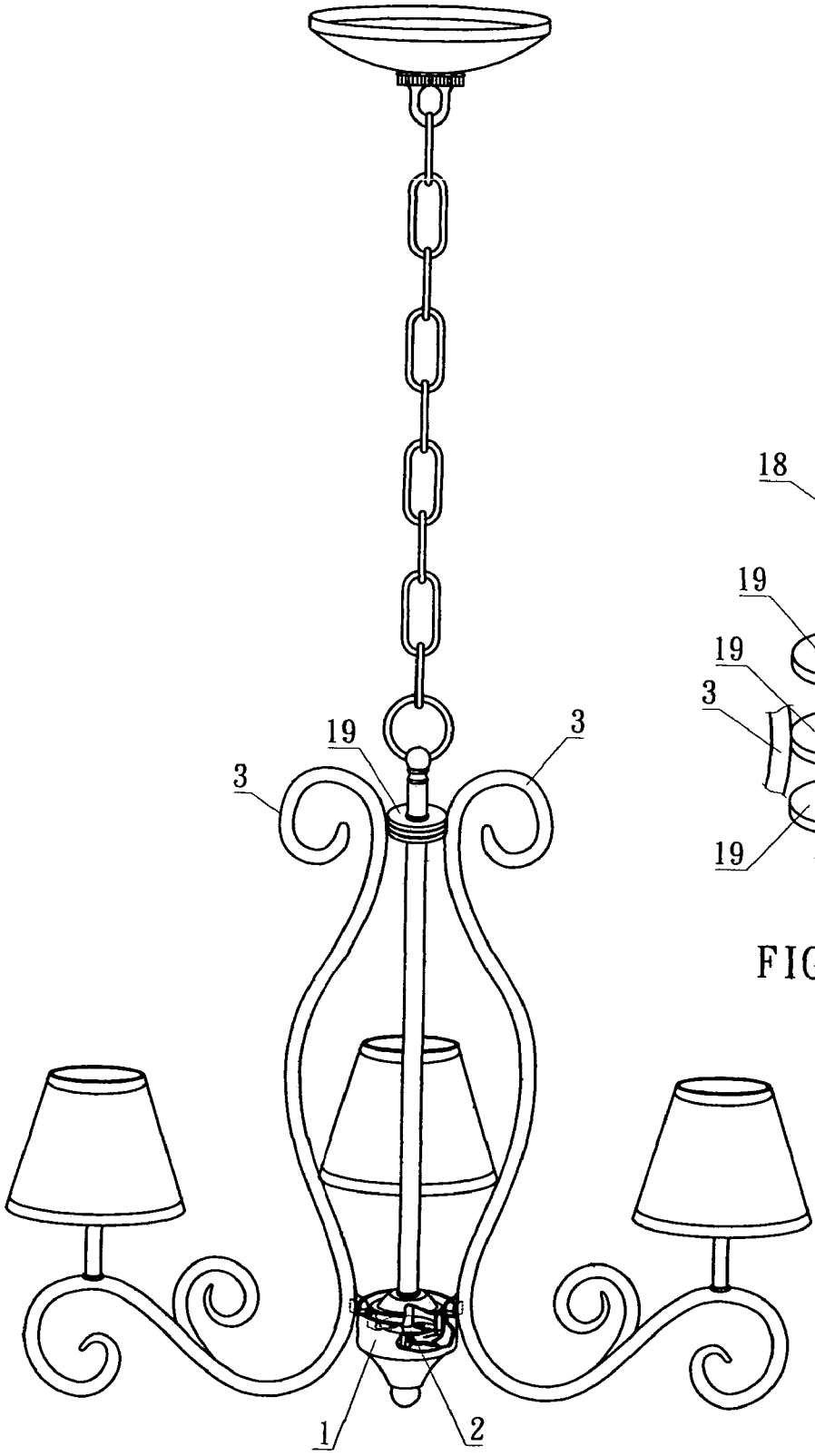
FIG7
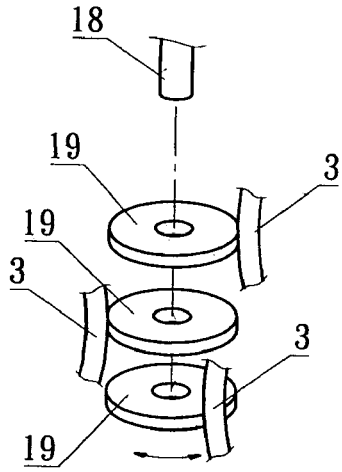
FIG7-A

FOLDABLE CEILING LAMP

FIELD OF THE INVENTION

The present invention relates to ceiling lamps, and particularly to a foldable ceiling lamp.

BACKGROUND OF THE INVENTION

In the prior art, the wire connecting box of a lamp is locked to a retaining block. The center of the block has a hole. A threaded tube is locked to the retaining block. The threaded tube passes through a hole in the retaining block. Then the threaded tube is fixed by screwing with a male nut so that the retaining block will not fall down. A lower side of the retaining block is fixed with a hanging ring so that a lamp can be suspended from the ring. Thereby, the buckling block can load the lamp. However, above prior art has the following defects. Firstly, the prior art retaining block is made of iron which is cheap, but weak. It is often that after it is used for a time period, the retaining block cracks and thus is dangerous. Moreover, in assembly, the lamp is heavy and much labor is necessary in assembly. Thus the cost is high and the operation is inconvenient.

SUMMARY OF THE INVENTION

Accordingly, the primary object of the present invention is to provide a foldable ceiling lamp which comprises a wire connection box, a limiting disk, and a lamp rod. The wire connection box includes an upper cover and a wire connection box body. A gap is formed between the upper cover and the body for being inserted by a supporting plate of the lamp rod. The limiting disk has a plurality of positioning pivotal holes formed on the limiting disk near an edge of the limiting. Each of the positioning pivotal hole is surrounded by a plurality of embedding holes. A bottom of the lamp rod is installed with a plurality of stepped supporting plates. The supporting plates are installed on the positioning pivotal holes of the limiting disk by a pivotal stud. When the supporting plate rotates around the stud, the convex portion of the supporting plate is embedded into one embedding hole. Thus, the lamp rod is rotatable.

The various objects and advantages of the present invention will be more readily understood from the following detailed description when read in conjunction with the appended drawing.

BRIEF DESCRIPTION OF THE DRAWINGS

FIGS. 3A and 3B show one embodiment about the angle adjustment of the supporting plate and the limiting disk of the present invention.

FIGS. 6A and 6B show one embodiment about the adjustment of the supporting plate of the present invention.

FIG. 7 show the embodiment about the foldable ceiling lamp of the present invention.

FIG. 7A shows one embodiment about the orientation adjustment of the lamp rod of the present invention.

DETAILED DESCRIPTION OF THE PREFERRED EMBODIMENTS

Figure 1:
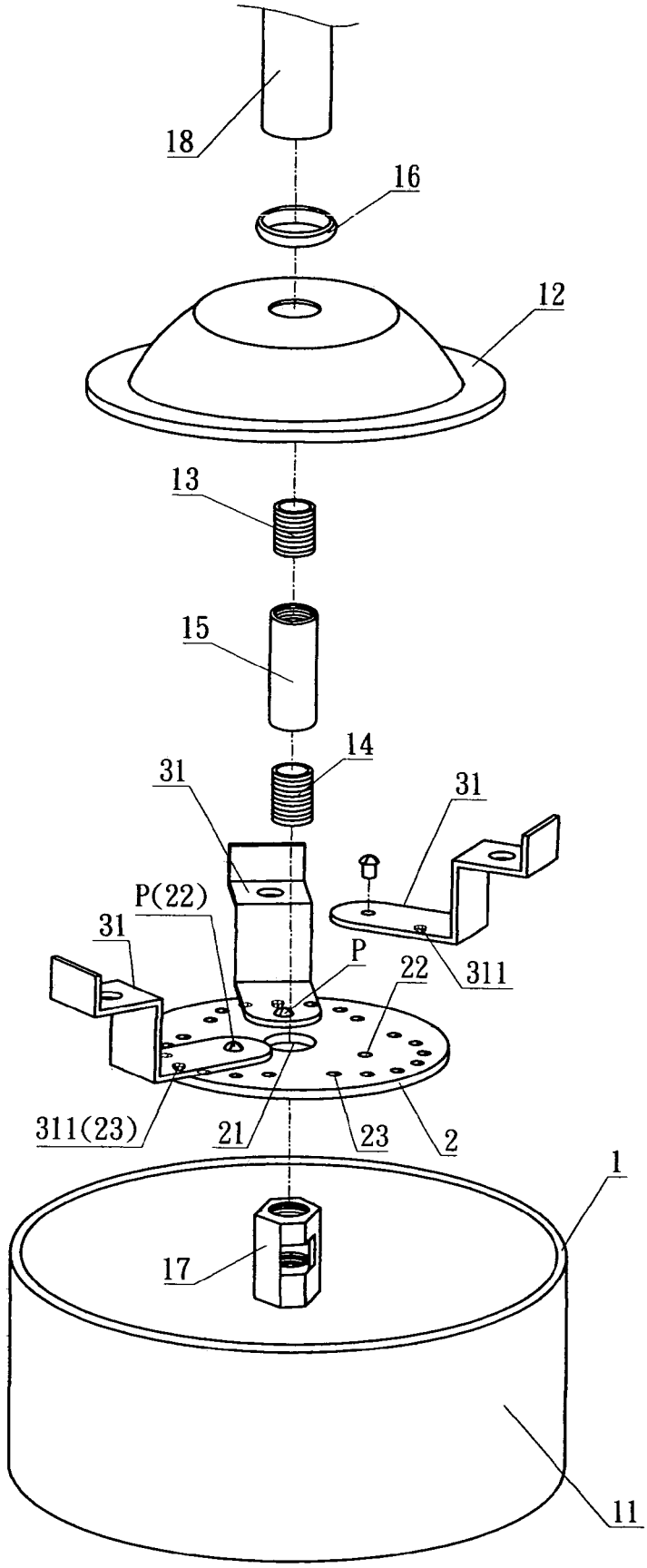
FIG. 1 is an exploded perspective view of the present invention.
Figure 2:
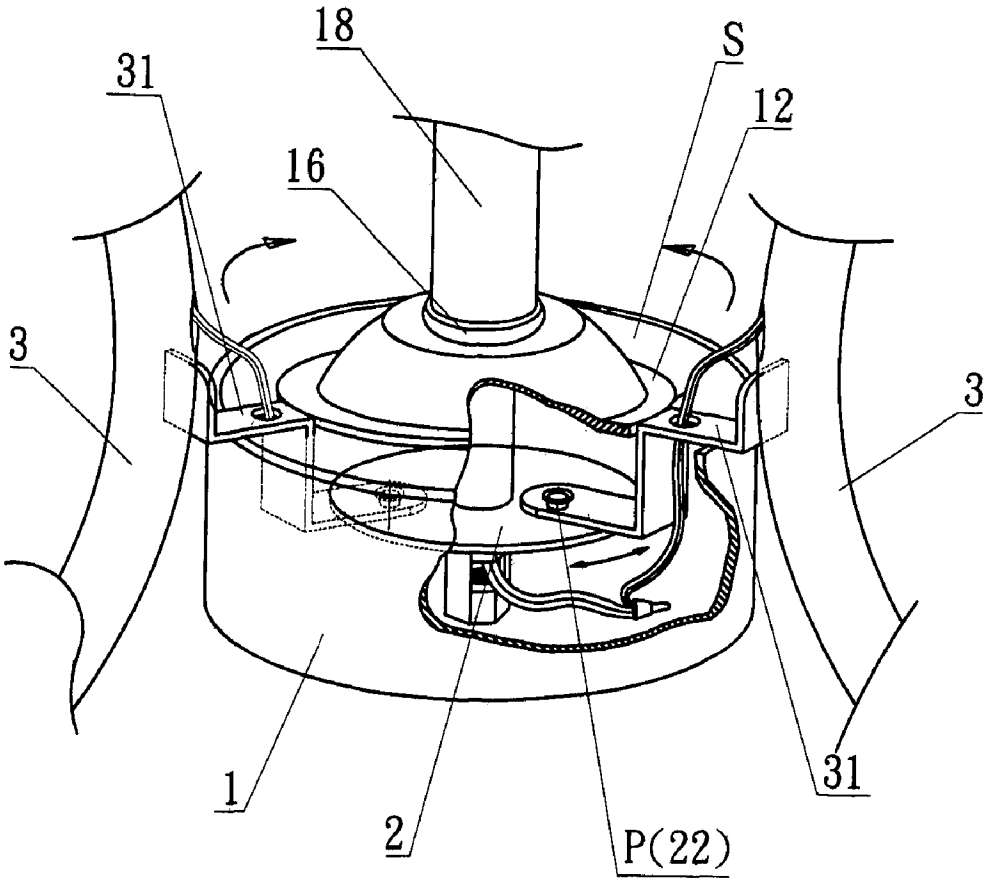
FIG. 2 is an assembled perspective view of the present invention.

Referring to FIGS. 1 and 2, the present invention includes a wire connection box 1, a limiting disk 2 assembled within the wire connection box 1, and a lamp rod 3 firmly secured to the limiting disk 2.

The wire connection box 1 includes an upper cover 12 and a wire connection box body 11. An upper screw rod 13, a lower screw rod 14, a threaded sleeve 15, and a washer 16 serves to lock the upper cover 12 and the wire connection box body 11. A gap is formed between the upper cover 12 and the body 11 for being inserted by a supporting plate 31 of the lamp rod 3.

The limiting disk 2 is locked to a locking block 17 in the wire connection box 1 by the lower screw rod 14 inserting into a central hole 21 of the limiting disk 2. The threaded sleeve 15 serves to lock the upper screw rod 12 and the lower screw rod 14. A top of the upper screw rod 13 protrudes from an outer side of the upper cover 12 of the wire connection box 1 and then passes through the washer 16. The upper screw rod 13 is firmly secured to the suspending rod 18 above the wire connection box 1 so as to position the limiting disk 2 within the wire connection box 1. A plurality of positioning pivotal holes 21 are formed on the limiting disk 2 near the edges of the limiting disk 2 for positioning the supporting plate 31 of the lamp rod 3. Each of the pivotal hole 21 is surrounded by a plurality of embedding holes 23 which are arranged near the edge of the limiting disk 2 for embedding the supporting plate 31 of the lamp rod 3.

A top of each lamp rod 3 is firmly secured to an edge of a corresponding toggle 19. The toggles 19 rotatably encloses around the suspending rod 18. Thereby, the lamp rod 3 can rotate with the toggle 19 synchronously so as to adjust the orientation of the lamp rod 3 (referring to FIG. 7A). A bottom of the lamp rod 3 is installed with a plurality of stepped supporting plates 31. The supporting plates 31 are installed on the positioning pivotal holes 22 of the limiting disk 2 by a pivotal stud P. Each supporting plate 31 has a downward protruded with a confining convex portion 311. Thereby, when the supporting plate 31 rotates around the stud P, the convex portion 311 of the supporting plate 31 can be embedded into one embedding hole 23. Thus, the lamp rod 3 is rotatable.

The operation of the present invention will be described herein with reference to FIG. 3. The limiting disk 2 and the wire connection box 1 are firmly secured to the suspending rod 18 by the screw rods 13, and 14 and the threaded sleeve 15. Thereby, the supporting plate 31 of the lamp rod 3 inserts into the gap S between the upper cover 12 and the body 11 of the wire connection box 1 so as to be pivotally installed to the positioning pivotal hole 22 of the limiting disk 2. Thereby, the supporting plate 31 is able to rotate on the limiting disk 2. By the positioning convex portion 311 at the bottom of the supporting plate 31, the direction of the supporting plate 31 is adjustable so that the positioning convex portion 311 of the supporting plate 31 is buckled in one of the embedding hole 23 of the limiting disk 2 and thus the supporting plate 31 is fixed to a predetermined position. Thus, in the present invention, the orientation of the piston rod 3 and the wire connection box 1 is adjustable.

Figure 4:
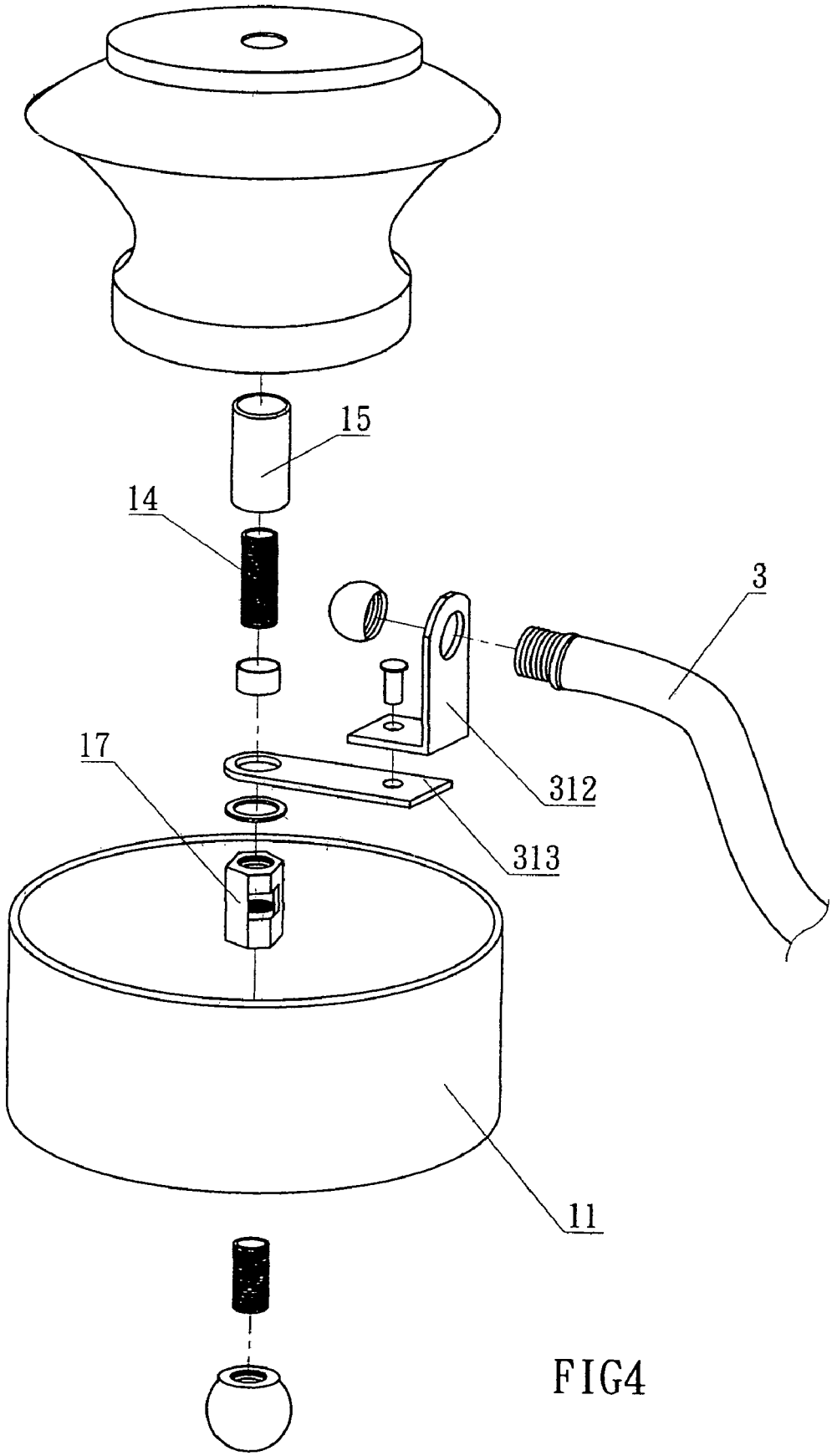
FIG. 4 is an exploded perspective view of the supporting plate of the present invention.
Figure 5:
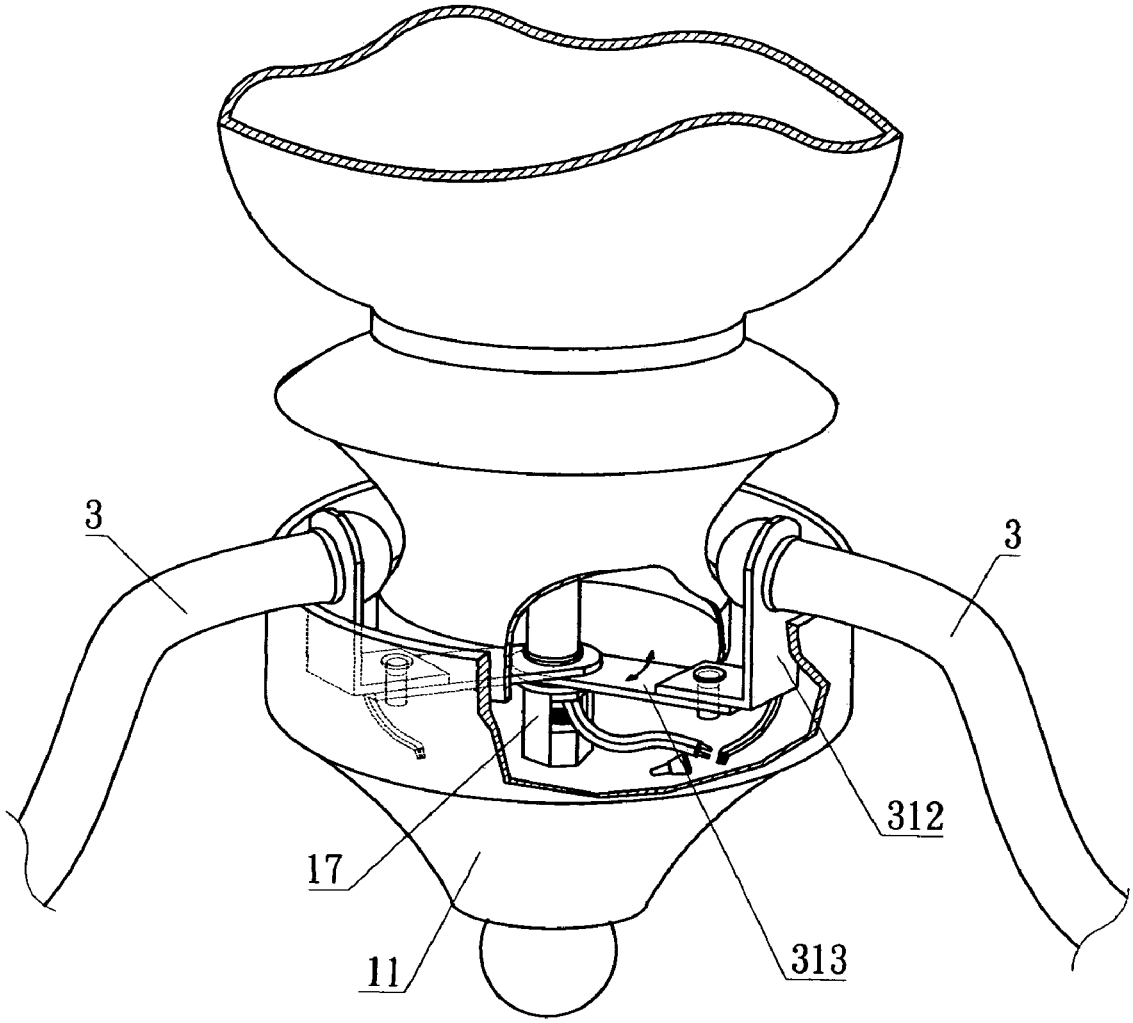
FIG. 5 is an assembled perspective view about the supporting plate of the present invention.

Referring to FIGS. 4 to 6, another embodiment of the present invention is illustrated. The supporting plate 31A is formed by two plates 312, 313 which are pivotally installed to one another so as to be formed with a stepped shape. The two plates 312, 313 are able to rotate with respect to one another so that the supporting plate 31A is rotatable around the pivotal portion P1. Moreover, the angles of the piston rod 3 and the wire connection box 1 are adjustable by the supporting plate 31 to be buckled with different embedding hole 23. Thereby, the two plates 312, 313 can drive the lamp rod 3 to be arranged horizontally so as to reduce the space occupied by the lamp rod 3 and the wire connection box 1.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A foldable ceiling lamp comprising a wire connection box, a limiting disk assembled within the wire connection box, and a lamp rod firmly secured to the limiting disk; wherein the wire connection box including an upper cover and a wire connection box body; an upper screw rod, a lower screw rod, a threaded sleeve, and a washer serving to lock the upper cover and the wire connection box body; a gap is formed between the upper cover and the body for being inserted by one of a plurality of supported plates of the lamp rod;

the limiting disk has a plurality of positioning pivotal holes formed on the limiting disk near an edge of the limiting disk for positioning the supporting plates of the lamp rod; each of the positioning pivotal hole is around by a plurality of embedding holes which are arranged near the edge of the limiting disk for embedding the supporting plates of the lamp rod;

a bottom of the lamp rod is installed with a plurality of stepped supporting plates; the supporting plates are installed on the positioning pivotal holes of the limiting disk by using a pivotal stud; each supporting plate has a downward protruded with a confining convex portion; thereby, when one of the supporting plates rotates around the stud, the convex portion of the supporting plate is embedded into one embedding hole; thus, the lamp rod is rotatable.

2. The foldable ceiling lamp as claimed in claim 1, wherein the limiting disk is locked to a locking block in the wire connection box by the lower screw rod inserting into a central hole of the limiting disk; the threaded sleeve serves to lock the upper screw rod and the lower screw rod; a top of the upper screw rod protrudes from an outer side of the upper cover of the wire connection box and then passes through the washer; the upper screw rod is firmly secured to the suspending rod above the wire connection box so as to position the limiting disk within the wire connection box.

3. The foldable ceiling lamp as claimed in claim 1, wherein a top of the lamp rod is firmly secured to an edge of a corresponding toggle; the toggles are rotatably enclosed around the suspending rod; thereby, the lamp rod is able to rotate with the toggle synchronously so as to adjust the orientation of the lamp rod.

4. The foldable ceiling lamp as claimed in claim 1, wherein each supporting plate is formed by two plates which are pivotally installed to one another so as to be formed with a stepped shape; the two plates are able to rotate with respect to one another so that the supporting plate is rotatable around the pivotal portion; moreover; thereby, the two plates drive the lamp rod so that the lamp rod is arranged horizontally to reduce the space occupied by the lamp rod and the wire connection box.

* * * * *